US009542901B2

(12) United States Patent
Kim et al.

(10) Patent No.: US 9,542,901 B2
(45) Date of Patent: Jan. 10, 2017

(54) DISPLAY DEVICE

(71) Applicant: Samsung Display Co. Ltd., Yongin (KR)

(72) Inventors: Kyung Ho Kim, Seongnam-si (KR); Kee Bum Park, Cheonan-si (KR)

(73) Assignee: SAMSUNG DISPLAY CO. LTD., Yongin (KR)

( * ) Notice: Subject to any disclaimer, the term of this patent is extended or adjusted under 35 U.S.C. 154(b) by 0 days.

(21) Appl. No.: 14/477,020

(22) Filed: Sep. 4, 2014

(65) Prior Publication Data

US 2015/0310821 A1 Oct. 29, 2015

(30) Foreign Application Priority Data

Apr. 25, 2014 (KR) ..... 10-2014-0049666

(51) Int. Cl.
*G06F 3/038* (2013.01)
*G09G 5/00* (2006.01)
*G09G 3/36* (2006.01)

(52) U.S. Cl.
CPC .... *G09G 3/3677* (2013.01); *G09G 2300/0408* (2013.01); *G09G 2300/0426* (2013.01); *G09G 2310/0286* (2013.01)

(58) Field of Classification Search
CPC ..... G09G 3/3688; G09G 3/3648; G09G 2330/021
USPC ..... 345/87–100, 204
See application file for complete search history.

(56) References Cited

U.S. PATENT DOCUMENTS

| | | | | |
|---|---|---|---|---|
| 6,847,422 | B2 | 1/2005 | Zhang et al. | |
| 8,139,194 | B2 | 3/2012 | Yamamoto et al. | |
| 8,325,319 | B2 | 12/2012 | Ikeguchi | |
| 8,432,334 | B2 | 4/2013 | Bang et al. | |
| 2007/0285370 | A1* | 12/2007 | Kim | G02F 1/1345 345/92 |
| 2008/0062104 | A1* | 3/2008 | Lee | G09G 3/3614 345/90 |
| 2011/0248968 | A1 | 10/2011 | Suh | |
| 2012/0062545 | A1* | 3/2012 | Kim | G09G 3/3233 345/212 |
| 2012/0188290 | A1* | 7/2012 | Park | G09G 3/3266 345/690 |

(Continued)

FOREIGN PATENT DOCUMENTS

| | | | |
|---|---|---|---|
| JP | 2006343563 | A | 12/2006 |
| JP | 2010122461 | A | 6/2010 |

(Continued)

*Primary Examiner* — Kimnhung Nguyen
(74) *Attorney, Agent, or Firm* — Cantor Colburn LLP

(57) ABSTRACT

A display device includes a display substrate, on which a display area and a non-display area are defined, a plurality of gate lines arranged in the display area to extend in a first direction, a gate driving unit including a plurality of stages which outputs gate signals to the plurality of gate lines, and a plurality of pixel rows disposed in the display area and connected to the plurality of gate lines, where a driving area and an electrode area are defined in the display area between two adjacent pixel rows in a second direction among the plurality of pixel rows, at least a part of the plurality of stages is disposed in the driving area, and a compensation electrode is disposed in the electrode area.

19 Claims, 9 Drawing Sheets

(56) References Cited

U.S. PATENT DOCUMENTS

| | | | | |
|---|---|---|---|---|
| 2013/0321499 | A1* | 12/2013 | Park | G09G 3/3611 345/698 |
| 2014/0028534 | A1 | 1/2014 | Park et al. | |
| 2014/0240302 | A1* | 8/2014 | Chen | G09G 3/3614 345/212 |

FOREIGN PATENT DOCUMENTS

| | | | |
|---|---|---|---|
| KR | 1020030008072 | A | 1/2003 |
| KR | 1020090010008 | A | 1/2009 |
| KR | 1020110067450 | A | 6/2011 |
| KR | 1020120113942 | A | 10/2012 |

* cited by examiner

DISPLAY DEVICE

This application claims priority to Korean Patent Application No. 10-2014-0049666, filed on Apr. 25, 2014, and all the benefits accruing therefrom under 35 U.S.C. §119, the content of which in its entirety is herein incorporated by reference.

BACKGROUND

1. Field

Exemplary embodiments of the invention relate to a display device.

2. Description of the Prior Art

In general, a display device may include a display panel and a driving unit that drives the display panel. The driving unit typically includes a data driving unit that applies a data voltage to a pixel of the display panel and a gate driving unit that applies a gate signal for controlling transfer of the data voltage. The gate driving unit and the data driving unit are typically mounted on a printed circuit board ("PCB") in the form of a chip and are connected to the display panel, or the driving unit chip may be directly mounted on the display panel. Recently, the gate driving unit having a structure in which the gate driving unit is integrated onto the display panel has been developed.

SUMMARY

Recently, there is an increasing demand for a display device having a small non-display area in the vicinity of a display area of a display panel on which an image is displayed. If the non-display area becomes large, the display area for displaying the image becomes relatively small, and may not be effectively used for a tiled display device.

Exemplary embodiments of the invention relate to a display device which has a reduced size of a non-display area.

In an exemplary embodiment of the invention, a display device includes a display substrate, on which a display area and a non-display area are defined; a plurality of gate lines arranged in the display area to extend substantially in a first direction; a gate driving unit including a plurality of stages which outputs gate signals to the plurality of gate lines; and a plurality of pixel rows disposed in the display area and connected to the plurality of gate lines, where a driving area and an electrode area are defined in the display area between two adjacent pixel rows in a second direction among the plurality of pixel rows, at least a part of the plurality of stages is disposed in the driving area, and a compensation electrode is disposed in the electrode area.

In an exemplary embodiment, an n-th stage among the plurality of stages may include a first transistor which outputs a first clock signal as an n-th gate signal; and a second transistor which discharges a voltage of an output node connected to the first transistor down to a low voltage, where n is a natural number, and the first transistor and the second transistor are disposed in the driving area.

In an exemplary embodiment, at least one of the first transistor and the second transistor may include a plurality of transistors disconnected from each other.

In an exemplary embodiment, the first transistor may include a control terminal connected to a control node of the n-th stage, an input terminal to which the first clock signal is applied, and an output terminal connected to an n-th gate line among the plurality of gate lines, and the second transistor may include a control terminal to which a gate signal from a next stage of the n-th stage is applied, an input terminal which receives the low voltage, and a second output terminal connected to the output terminal of the first transistor.

In an exemplary embodiment, the n-th stage may further include a third transistor which discharges the voltage of the output node down to the low voltage in response to a signal synchronized with the first clock signal.

In an exemplary embodiment, the n-th stage may further include a carry unit which outputs the first clock signal as an n-th carry signal in response to a signal applied to a control terminal of the first transistor.

In an exemplary embodiment, the n-th stage may further include first holding unit including a transistor including a control terminal which receives the first clock signal, an input terminal connected to a control terminal of the first transistor, and an output terminal connected to an output terminal of the first transistor; a second holding unit which holds a voltage applied to the first control electrode as a low voltage of a carry signal from a previous stage in response to a second clock signal; a third holding unit which holds a voltage applied to the output terminal of the first transistor as the low voltage in response to the second clock signal; a second discharge unit which discharges a voltage applied to the control terminal of the first transistor down to the low voltage in response to a reset signal; and a first discharge unit which discharges the voltage applied to the control terminal of the first transistor down to the low voltage in response to a gate signal from a next stage.

In an exemplary embodiment, the driving area may be defined at an edge of the display area.

In an exemplary embodiment, the compensation electrode may be disposed in a same layer as the plurality of gate lines.

In an exemplary embodiment, a holding voltage may be applied to the compensation electrode.

In an exemplary embodiment, the display device according to the invention may further include a plurality of data lines extending substantially in the second direction on the display area, where a pixel in the plurality of pixel rows includes a first sub-pixel including a first sub-pixel electrode and a first pixel transistor and a second sub-pixel including a second sub-pixel electrode, a second pixel transistor and a third pixel transistor, the first pixel transistor includes a control terminal connected to a corresponding gate line of the plurality of gate lines, an input terminal connected to a corresponding data line of the plurality of data lines, and an output terminal connected to the first sub-pixel electrode, the second pixel transistor includes a control terminal connected to the corresponding gate line, an input terminal connected to the corresponding data line, and an output terminal connected to the second sub-pixel electrode, and the third pixel transistor includes a control terminal connected to the corresponding gate line, an input terminal connected to the output terminal of the second pixel electrode, and an output terminal to which a holding voltage is applied.

In another exemplary embodiment of the invention, a display device includes a display substrate, on which a display area and a non-display area are defined; a plurality of gate lines arranged in the display area to extend substantially in a first direction; a gate driving unit including a plurality of stages which outputs gate signals to the plurality of gate lines; and a plurality of pixel rows disposed in the display area and connected to the plurality of gate lines, where a driving area and an electrode area are defined in the display area between two adjacent pixel rows in a second direction among the plurality of pixel rows, and a driving signal interconnection unit, which is electrically connected to the gate driving unit and is arranged to extend substantially in the first direction, is disposed in the driving area.

In an exemplary embodiment, an n-th stage among the plurality of stages may include a first sub-stage disposed in the non-display area; and a second sub-stage disposed in the driving area and connected to the first sub-stage and a corresponding gate line.

In an exemplary embodiment, the driving signal interconnection unit may include a first signal interconnection to which a first clock signal is applied; and a second signal interconnection electrically connected to a control node of the first sub-stage, and the second sub-stage may include a first transistor including a control terminal connected to the second signal interconnection, an input terminal connected to the first signal interconnection, and an output terminal connected to the n-th gate line among the plurality of gate lines.

In an exemplary embodiment, the driving signal interconnection unit may further include a third signal interconnection to which a low voltage is applied, and a fourth signal interconnection to which a gate signal from a next stage of the n-th stage is applied, and the second sub-stage may further include a second transistor including a second control terminal connected to the fourth signal interconnection, a second input terminal connected to the third signal interconnection, and a second output terminal connected to the output terminal of the first transistor.

In an exemplary embodiment, the display device may further include a compensation electrode disposed in the electrode area.

In an exemplary embodiment, the compensation electrode may be disposed in a same layer as the plurality of gate lines.

In an exemplary embodiment, a holding voltage may be applied to the compensation electrode.

In an exemplary embodiment, the driving area may be defined at an edge of the display area.

In an exemplary embodiment, the display device may further include a plurality of data lines extending substantially in the second direction on the display area, where a pixel in the plurality of pixel rows includes a first sub-pixel including a first sub-pixel electrode and a first pixel transistor, and a second sub-pixel including a second sub-pixel electrode, a second pixel transistor and a third pixel transistor, the first pixel transistor includes a control terminal connected to a corresponding gate line of the plurality of gate lines, an input terminal connected to a corresponding data line of the plurality of data lines, and an output terminal connected to the first sub-pixel electrode, the second pixel transistor includes a control terminal connected to the corresponding gate line, an input terminal connected to the corresponding data line, and an output terminal connected to the second sub-pixel electrode, and the third pixel transistor includes a control terminal connected to the corresponding gate line, an input terminal connected to the output terminal of the second pixel electrode, and an output terminal to which a holding voltage is applied.

According to exemplary embodiments of the invention, a display device having a reduced size of a non-display area may be provided.

BRIEF DESCRIPTION OF THE DRAWINGS

The above and other features of the invention will be more apparent from the following detailed description taken in conjunction with the accompanying drawings, in which.

DETAILED DESCRIPTION

Figure 1:
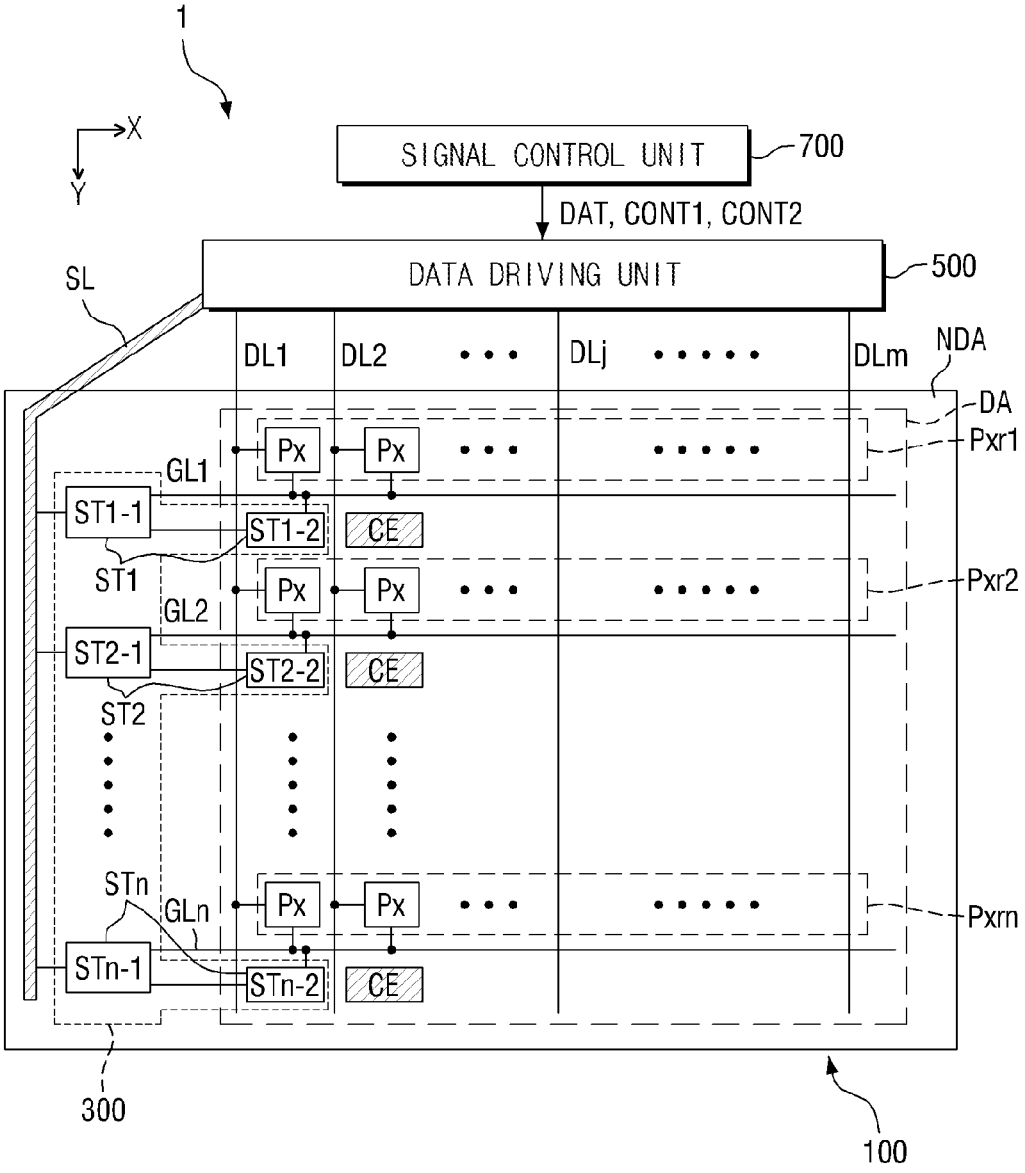
FIG. 1 is a schematic plan view of an exemplary embodiment of a display device according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiments of the invention will be described in detail with reference to the accompanying drawings.

FIG. 1 is a schematic plan view of an exemplary embodiment of a display device according to the invention.

Referring to FIG. 1, an exemplary embodiment of a display device 1 may include a display substrate 100 and a gate driving unit 300, and may further include a data driving unit 500 and a signal control unit 700.

The display substrate 300 is a panel that displays an image, and may be a liquid crystal display panel, an electrophoretic display panel, an organic light emitting diode ("OLED") panel, a light emitting diode ("LED") panel, an inorganic electroluminescent ("EL") display panel, an electro-wetting display ("EWD") panel, a field emission display ("FED") panel, a surface-conduction electron-emitter display ("SED") panel, a plasma display panel ("PDP"), or a cathode ray tube ("CRT") display panel, for example.

The display substrate 100 may include a display area DA on which an image is displayed and a non-display area NDA except for the display area DA.

In an exemplary embodiment, a plurality of gate lines GL1 to GLn, a plurality of data lines DL1 to DLm, and a plurality of pixels Px that are connected to the plurality of gate lines GL1 to GLn and the plurality of data lines DL1 to DLm may be disposed in the display area. Here, each of n and m are a natural number greater than 1.

The gate lines GL1 to GLn transfer gate signals to the pixels Px, and may extend substantially in a first direction (e.g., an X direction or a row direction). The gate lines GL1 to GLn may be substantially parallel to each other.

The data lines Dl1 to DLm transfer data voltages that correspond to an image signal to the pixels Px, and may extend substantially in a second direction (e.g., a Y direction or a column direction) to cross the gate lines GL1 to GLn. In an exemplary embodiment, the data lines DL1 to DLm (may be substantially parallel to each other.

The plurality of pixels Px may be arranged substantially in a matrix form, and may include a plurality of pixel rows Pxr1 to Pxrn that are arranged in the column direction (or the Y direction). Each of the pixel rows Pxr1 to Pxrn may include a plurality of pixels Px arranged in the row direction, and one of the pixel rows Pxr1 to Pxrn may include at least m pixels Px that corresponds to the number of data lines DL1 to DLm. Herein, r is a natural number in a range of 1 to n. Each of the pixel rows Pxr1 to Pxrn may be connected to any one of the plurality of gate lines GL1 to GLn, but is not limited thereto. In one alternative exemplary embodiment, for example, each of the pixel rows Pxr1 to Pxrn may be connected to two or more gate lines or one gate line may be arranged for two or more pixel rows Pxr1 to Pxrn. In such an embodiment, the number of gate lines GL1 to GLn may be different from the number of pixel rows Pxr1 to Pxrn.

A driving area and an electrode area may be defined in the display DA between two adjacent pixel rows in a column direction (or a second direction) among the plurality of pixel rows. A part of the gate driving unit 300 may be disposed or positioned in the driving area, and a compensation electrode CE may be positioned in the electrode area. The driving area and the electrode area will be described later in greater detail.

Each pixel Px may include a switching element (not illustrated) connected to the gate lines GL1 to GLn and the data lines DL1 to DLm and a pixel electrode (not illustrated) connected to the switching element. The switching element may include a three-terminal element, such as a pixel transistor, that is integrated onto the display substrate 100. In an exemplary embodiment, the pixel transistor may be a thin film transistor ("TFT"). The pixel Px will be described later in greater detail with reference to FIG. 3.

The non-display area NDA of the display substrate 100 may be covered by a light blocking member (not illustrated in the drawing), such as a bezel, for example.

The gate driving unit 400 and a plurality of control signal lines SL may be positioned in the non-display area NDA, and at least a part of the gate driving unit 400 may be positioned in the display area DA. In an exemplary embodiment, the data driving unit 500 may be integrated into the non-display area NDA of the display substrate 100 or may be mounted on the non-display area NDA of the display substrate 100 in the form of a plurality of driving chips.

In such an embodiment, parts of the gate lines GL1 to GLn and the data lines DL1 to DLm positioned in the display area DA may extend to the non-display area NDA.

The signal control unit 700 may control the data driving unit 500 and the gate driving unit 300. The signal control unit 700 receives an input image signal from an external graphic controller (not illustrated) and input control signals for controlling display of the image signal. In an exemplary embodiment, the input control signals may include a vertical sync signal, a horizontal sync signal, a main clock signal, and a data enable signal, for example.

The signal control unit 700 converts the input image signal into a digital image signal DAT through a predetermined processing of the input image signal based on the input image signal and the input control signal, and generates a gate control signal CONT1 and a data control signal CONT2. In an exemplary embodiment, the signal control unit 700 sends the gate control signal CONT1 to the gate driving unit 300 and sends the data control signal CONT2 and the processed image signal DAT to the data driving unit 500.

The gate control signal CONT1 may include a scan start signal for indicating a scan start, a clock signal for controlling an output period of a gate-on voltage, and a low voltage.

The data control signal CONT2 may include a horizontal sync start signal for notifying of a transmission start of image data for pixels Px of one row, a load signal for applying the data signal to the data lines DL1 to DLm, and a data clock signal. The data control signal CONT2 may further include a reverse signal for reversing a voltage polarity (hereinafter referred to as "voltage polarity of a data signal with respect to a common voltage" or "polarity of a data signal") of the data signal with respect to the common voltage Vcom.

In an exemplary embodiment, the data driving unit 500 may receive the digital image signal DAT for pixels Px of one row, convert the digital image signal DAT into an analog data signal through selection of a gradation voltage that corresponds to the digital image signal DAT, and then apply the analog data signal to the corresponding data lines DL1 to DLm, based on the data control signal CONT2 from the signal control unit 700.

The gate driving unit 300 turns on the switching element of the pixel Px connected to the gate lines GL1 to GLn through applying of the gate-on voltage Von to the gate lines GL1 to GLn, based on the gate control signal CONT1 from the signal control unit 700. Accordingly, the data signal that is applied to the data lines DL1 to DLm may be applied to the corresponding pixel Px through the turned-on switching element.

In an exemplary embodiment, the signal control unit 700 or the data driving unit 500 may be directly mounted on the display substrate 100 in the form of at least one integrated circuit or an integrated circuit ("IC") chip, or may be mounted on a flexible film to be attached to the display substrate 100. In an alternative exemplary embodiment, the signal control unit 700 or the data driving unit 500 may be mounted on a separate printed circuit board (not illustrated). In an exemplary embodiment, as shown in FIG. 1, the signal control unit 700 and the data driving unit 500 may be integrated onto the display substrate 100 together with the signal lines GL1 to GLn and DL1 to DLm and the switching element of the pixel Px.

The data driving unit 500 is connected to the data lines DL1 to DLm of the display substrate 100 to transfer the data voltage to the data lines DL1 to DLm. The data driving unit 500 may receive the data control signal CONT2 and the digital image signal DAT from the signal control unit 700, convert the digital image signal DAT into an analog data signal through selection of the gradation voltage that corresponds to the digital image signal, and then apply the analog data signal to the corresponding data lines DL1 to DLm. The data driving unit 500 may include a plurality of data driving chips. In an exemplary embodiment, the data driving unit 500 may be integrated onto the display substrate 100 together with the thin film transistors during a same process for providing the thin film transistors in the display area DA of the display substrate 100.

The gate driving unit 300 may receive the control signal, such as the gate control signal CONT1, from the data driving unit 500 through the plurality of control signal lines SL connected to the data driving unit 500, generate a gate signal composed of a gate-on voltage and a gate-off voltage, and apply the gate signal to the gate lines GL1 to GLn. The gate-on voltage is a voltage that turns on the thin film transistor, and the gate-off voltage is a voltage that turns off the thin film transistor.

The plurality of control signal lines SL may be positioned in the non-display area NDA, and may extend along the second direction (or the Y direction) in the non-display area NDA of the display substrate 100 on which a part of the gate driving unit 300 is positioned.

The gate driving unit 300 may include a plurality of stages ST1 to STn (where, n is a natural number) sequentially arranged or in a cascade connection. The plurality of stages ST1 to STn may be shift registers that are subordinately connected to each other, and each stage may include a plurality of circuit transistors that are provided or formed through the same process as the process of providing the switching element of the pixel Px, i.e., the pixel transistor. The plurality of stages ST1 to STn may be connected to the gate lines GL1 to GLn, and generate and successively transfer the gate signal to the gate lines GL1 to GLn. I one exemplary embodiment, for example, an i-th stage STi of the gate driving unit 300 may generate and provide the i-th gate signal Gi to the i-th gate line GLi, and the (i+1)-th stage ST(i+1) may generate and provide the (i+1)-gate signal G(i+1) to the (i+1)-th gate line GL(i+1).

The gate driving unit 300 may further include one or more dummy stages (not illustrated in the drawing) that are not electrically connected to the gate lines GL1 to GLn. The dummy stage may receive a clock signal, a low voltage, and a gate signal of the last stage and generate a dummy gate signal, and the generated dummy gate signal may be input again to the last stage. The display substrate 100 may further include a dummy gate line (not illustrated in the drawing) that is not related to the image display, and the dummy gate line may be connected to the dummy stage.

The plurality of stages ST1 to STn may include first sub-stages ST1-1 to STn-1 and second sub-stages ST1-2 to STn-2, and at least one of the first sub-stages ST1-1 to STn-1 and at least one of the second sub-stages ST1-2 to STn-2 that are included in a same stage may be electrically connected to each other.

In an exemplary embodiment, the first sub-stages ST1-1 to STn-1 may be positioned in the non-display area NDA, and the second sub-stages ST1-2 to STn-2 may be positioned in the display area DA. In an exemplary embodiment, as shown in FIG. 1, the plurality of stages ST1 to STn may include the first sub-stages ST1-1 to STn-1 that are positioned in the non-display area NDA and the second sub-stages ST1-2 to STn-2 that are positioned in the display area DA, but not being limited thereto.

The first sub-stages ST1-1 to STn-1 may be positioned in the non-display area NDA, and may be arranged substantially in the second direction (or Y direction). In an exemplary embodiment, as shown in FIG. 1, the first sub-stages ST1-1 to STn-1 may be positioned on the left side of the display area DA in the non-display area NDA, but not being limited thereto.

The second sub-stages ST1-2 to STn-2 may be positioned in the display area DA, and may be positioned between two adjacent pixel rows in the column direction (or Y direction) among the plurality of pixel rows Pxr1 to Pxrn.

Figure 2:
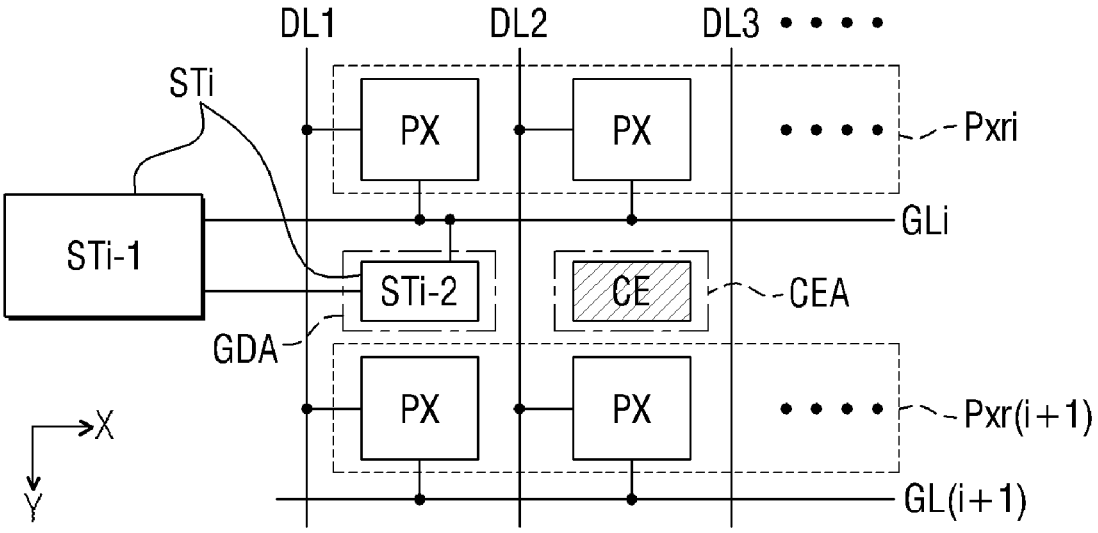
FIG. 2 is a schematic enlarged plan view of a part of an exemplary embodiment of a display device according to the invention.

FIG. 2 is a schematic enlarged plan view of a part of an exemplary embodiment of a display device according to the invention. More specifically, FIG. 2 shows the arrangement relationship between pixel rows, one stage, and a compensation electrode in the display device illustrated in FIG. 1.

Referring to FIGS. 1 and 2, two adjacent pixel rows Pxr1 and Pxr(i+1) along the column direction (or Y direction) may be connected to adjacent gate lines GLi and GL(i+1), respectively, and a driving area GDA and an electrode area CEA may be defined in the display DA between the two pixel rows Pxr1 and Pxr(i+1) (herein, i is a natural number that is equal to or less than n−1).

In an exemplary embodiment, as illustrated in FIG. 2, the driving area GDA may be positioned on the edge side of the display area DA. In such an embodiment, the driving area GDA may be positioned on a boundary portion between the display area DA and the non-display area NDA, and may be relatively adjacent to the non-display area NDA in comparison to the electrode area CEA based on the row direction (or X direction), but not being limited thereto. In an alternative exemplary embodiment, the position of the driving area GDA may be variously modified as needed.

As described above with reference to FIG. 1, a stage, e.g., an i-th stage STi, may include a first sub-stage STi-1 and a second sub-stage STi-2 that are electrically connected to each other. The first sub-stage STi-1 may be positioned in the non-display area NDA, and the second sub-stage STi-2 may be positioned in the driving area GDA in the display area DA. In an exemplary embodiment, a part of the stage STi is arranged in the display area DA, such that the area and the width occupied by the stage STi in the non-display area NDA may be reduced, and the area and the width of the non-display area NDA is thereby reduced.

In an exemplary embodiment, the electrode area CEA may be disposed in a portion except for the driving area GDA in a space between two pixel rows Pxri and Pxr(i+1), and the compensation electrode CE may be positioned in the electrode area CEA.

The compensation electrode CE may be positioned in a same layer as or at a same interconnection level as the gate lines GLi and GL(i+1). Herein, the term "a and b are at the same interconnection level" means that a and b are arranged in a same layer or directly on a same base layer. Further, a and b may be simultaneously provided or formed through a same process, but are not limited thereto. In an exemplary embodiment, the gate lines GLi and GL(i+1) and the compensation electrode CE may be positioned in a same layer or at a same interconnection level as each other, may be formed of a same material as each other, and may be simultaneously patterned to be provided through a same process, but are not limited thereto.

In an exemplary embodiment, the compensation electrode CE may be a floating electrode. In an exemplary embodiment, a holding voltage Vcst (shown in FIG. 3) may be applied to the compensation electrode CE, and the holding voltage Vcst may be applied to the compensation electrode CE through a separate interconnection (not illustrated in the drawing).

In an exemplary embodiment, where the second sub-stage STi-2 is arranged in the display area DA, coupling capacitance (hereinafter referred to as "first coupling capacitance") may occur between the second sub-stage STi-2, and the data lines D1, D2 and D3, and due to the first coupling capacitance as described above, a capacitance difference may occur between a portion in which the second sub-stage STi-2 and a portion where the second sub-stage STi-2 is not arranged.

According to an exemplary embodiment of the invention, the compensation electrode CE may be positioned in the electrode area CEA in which the second sub-stage STi-2 is not positioned, and coupling capacitance (hereinafter referred to as "second coupling capacitance") may be formed between the compensation electrode CE, and the data lines D1, D2 and D3. Accordingly, a capacitance difference between a portion in which the second sub-stage STi-2 is positioned and a portion in which the second sub-stage STi-2 is not arranged may be reduced, and as a result, stain occurrence that may be generated due to the capacitance difference may be effectively prevented.

Figure 3:
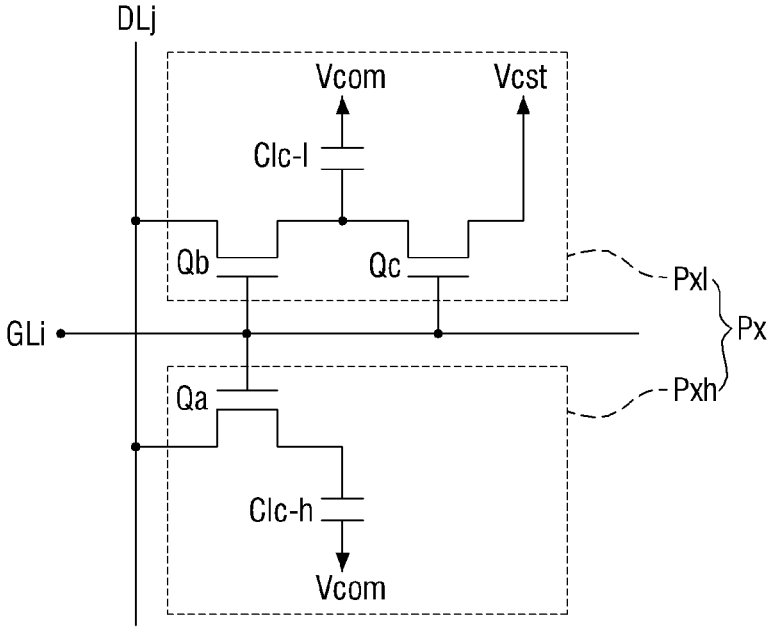
FIG. 3 is an equivalent circuit diagram of a pixel structure of an exemplary embodiment of a display device according to the invention.

FIG. 3 is an equivalent circuit diagram of a pixel structure of an exemplary embodiment of a display device according to the invention, Referring to FIG. 3, an exemplary embodiment of a display device according to the invention may include signal lines including a gate line GLi for transferring a gate signal and a data line DLj for transferring a data signal, and a pixel Px connected to the signal lines.

The pixel Px may include a first pixel transistor Qa, a second pixel transistor Qb, a third pixel transistor Qc, a first liquid crystal capacitor Clc-h and a second liquid crystal capacitor Clc-1.

The pixel Px may be divided into a first sub-pixel, e.g., a high-gradation sub-pixel Pxh, and a second sub-pixel, e.g., a low-gradation sub-pixel Pxl. In such an embodiment, the high-gradation sub-pixel Pxh may include the first pixel transistor Qa and the first liquid crystal capacitor Clc-h, and the low-gradation sub-pixel Pxl may include the second pixel electrode Qb, the third pixel transistor Qc and the second liquid crystal capacitor Clc-1. In such an embodiment, the first to third pixel transistors Qa, Qb and Qc may be three-terminal elements, such TFTs.

The first pixel transistor Qa and the second pixel transistor Qb may be connected to the gate line GLi and the data line DLj, and the third switching element Qc may be connected to the gate line GLi and the output terminal of the second switching element Qb (here, j is a natural number that is equal to or less than m).

In an exemplary embodiment, as shown in FIG. 3, the first pixel transistor Qa may include a control terminal connected to the gate line GLi, an input terminal connected to the data line DLj, and an output terminal connected to the first liquid crystal capacitor Clc-h. In such an embodiment, the second pixel transistor Qb may include a control terminal connected to the gate line GLi, an input terminal connected to the data line DLj, and an output terminal, and the output terminal of the second pixel transistor Qb may be connected to the second liquid crystal capacitor Clc-1 and the output terminal of the third pixel transistor Qc. In such an embodiment, the control terminals of the first pixel transistor Qa and the second pixel transistor Qb may be connected to the same gate line GLi, and the input terminals of the first pixel transistor Qa and the second pixel transistor Qb may be connected to the same data line DLj. In such an embodiment, the output terminal of the first pixel transistor Qa may be connected to the first liquid crystal capacitor Clc-h, and the output terminal of the second pixel transistor Qb may be connected to the second liquid crystal capacitor Clc-1 and the input terminal of the third pixel transistor Qc.

In an exemplary embodiment, the third pixel transistor Qc may include a control terminal connected to the same gate line GLi as the first pixel transistor Qa, an input terminal connected to the output terminal of the second pixel transistor Qb, and an output terminal to which a holding voltage is applied. In such an embodiment, the control terminal of the third pixel transistor Qc may be connected to the gate line GLi, the input terminal of the third pixel transistor Qc may be connected to the output terminal of the second pixel transistor Qb and the second liquid crystal capacitor Clc-1, and the output terminal of the third pixel transistor Qc may be connected to a holding voltage line (not illustrated in the drawing) to receive the holding voltage Vcst.

When a gate-on voltage is applied to the gate line GLi, the first pixel transistor Qa, the second pixel transistor Qb and the third pixel transistor Qc, which are connected to the gate line GLi, are turned on. Accordingly, the data voltage applied to the data line DLj is applied to a first sub-pixel electrode and a second sub-pixel electrode, which form terminals of the first liquid crystal capacitor Clc-h and the second liquid crystal capacitor Clc-1, through the first pixel transistor Qa and the second pixel transistor Qb, which are in a turned-on state. In such an embodiment, since the third pixel transistor Qc is in the turned-on state, the voltage that is applied to the second sub-pixel electrode is divided based on the voltage difference between the holding voltage Vcst and the input data voltage and the resistance value of the third pixel transistor Qc. The divided voltage is applied to the second sub-pixel electrode, and the second liquid crystal capacitor Clc-1 is charged based on the divided voltage. In such an embodiment, the voltage that is applied to the second sub-pixel electrode becomes lower than the voltage that is applied to the first sub-pixel electrode, and the voltage that is charged in the first liquid crystal capacitor Clc-h and the voltage charged in the second liquid crystal capacitor Clc-1 may become different from each other. In such an embodiment, the voltage that is charged in the first liquid crystal capacitor Clc-h and the voltage charged in the second liquid crystal capacitor Clc-1 are different from each other, such that the first sub-pixel Pxh and the second sub-pixel Pxl have different orientation directions, and thus the two sub-pixels Pxh and Pxl have different luminance values. Accordingly, in such an embodiment, where the front surface luminance is displayed through addition of luminance values of the two sub-pixels Pxh and Pxl, the side surface visibility may be improved on the side surface due to various liquid crystal orientations.

In an exemplary embodiment, through adjustment of the holding voltage Vcst that is provided to the pixel Px (e.g., through heightening of the holding voltage), the difference in kickback voltage between the first sub-pixel Pxh and the second sub-pixel Pxl may be reduced, and thus the display quality deterioration, such as flicker or afterimage, may be effectively prevented.

Figure 4:
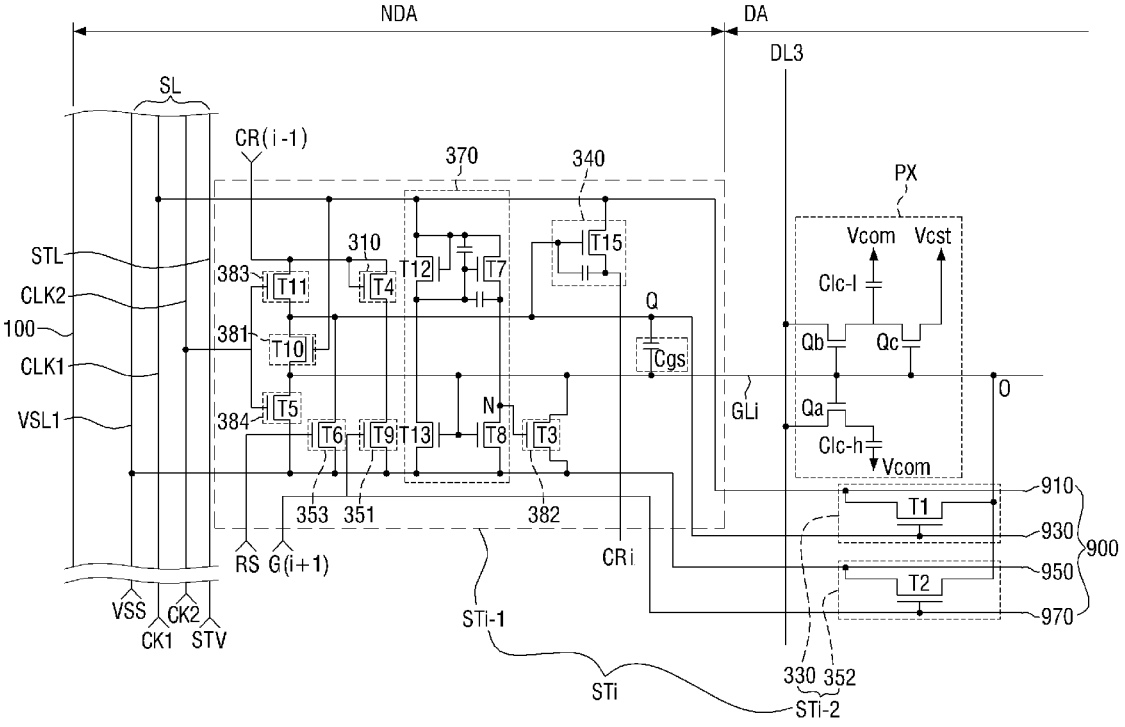
FIGS. 4 and 5 are equivalent circuit diagrams of an exemplary embodiment of a display device according to the invention.
Figure 5:
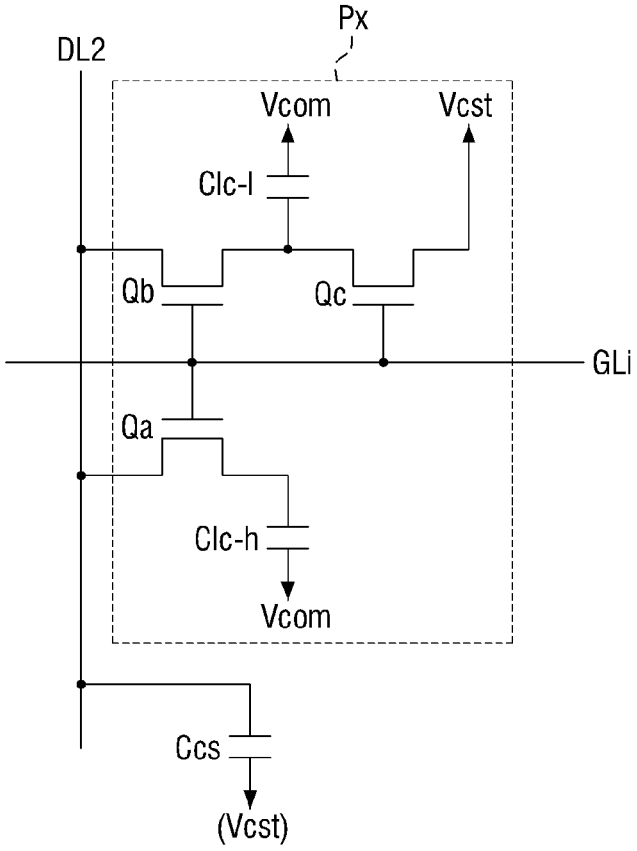

FIGS. 4 and 5 are equivalent circuit diagrams of an exemplary embodiment of a display device according to the invention. More specifically, FIG. 4 is an equivalent circuit diagram showing a stage and a pixel of an exemplary embodiment of a display device, and FIG. 5 is an equivalent circuit diagram showing a compensation electrode and a pixel of an exemplary embodiment of a display device.

Referring to FIGS. 1 to 4, in an exemplary embodiment, the control signal line SL and the first sub-stage STi-1 of the stage STi of the gate driving unit 300 (in FIG. 1) may be positioned in the non-display area NDA of the display substrate 100, and the pixel Px, the driving signal interconnection unit 900 and the second sub-stage STi-2 of the stage STi may be positioned in the display area DA.

The control signal line SL includes a first voltage interconnection VSL1, a first clock interconnection CLK1, a second clock interconnection CLK2 and a vertical start interconnection STL, for transferring a plurality of driving signals provided to the stage STi. In such an embodiment, the control signal line SL may further include a third clock interconnection and a fourth clock interconnection (not shown). The first voltage interconnection VSL1 transfers the low voltage VSS, the first clock interconnection CLK1 transfers the first clock signal CK1, the second clock CLK2 transfers the second clock signal CK2, and the vertical start interconnection STL transfers the vertical start signal STV.

Each of the plurality of stages ST1 to STn (in FIG. 1) included in the gate driving unit 300 (in FIG. 1) may include a plurality of transistors. In one exemplary embodiment, for example, an i-th stage STi (here, i is a natural number that is equal to or less than n) includes a buffer unit 310, a charge unit 320, a pull-up unit 330, a carry unit 340, a first discharge unit 351, a second discharge unit 352, a third discharge unit 353, a switching unit 370, a first holding unit 381, a second holding unit 382, a third holding unit 383 and a fourth holding unit 364.

The buffer unit 310 may include a fourth transistor T4. The control terminal and the input terminal of the buffer unit 310 receive the (i−1)-th carry signal CR(i−1) provided from the (i−1)-th stage, that is one of the previous stages, and the output terminal of the buffer unit 310 is connected to a control node Q (also referred to as Q node) of the i-th stage STi. The buffer unit 310 charges high voltage VDD of the (i−1)-th carry signal CR(i−1) in a boost capacitor Cgs of the charge unit 320 connected to the control node Q in response to the high voltage of the (i−1)-th carry signal CR(i−1).

The charge unit 320 may include the boost capacitor Cgs. A first terminal of the charge unit 320 is connected to the control node Q, and a second terminal of the charge unit 320 is connected to an output node O.

The pull-up unit 330 may include a first transistor T1. The control terminal of the pull-up unit 330 is electrically connected to the first terminal of the charge unit 320 connected to the control node Q, the input terminal thereof receives the first clock signal CK1, and the output terminal thereof is connected to the output node O. When the first clock signal CK1 is received by the input terminal of the pull-up unit 330 in a state where the high voltage that is charged in the boost capacitor Cgs is applied to the control terminal of the pull-up unit 330, the pull-up unit 330 is bootstrapped. When the pull-up unit 330 is bootstrapped, the boost capacitor Cgs boosts the charged voltage. In response to the boosted voltage, the pull-up unit 330 outputs the high voltage of the first clock signal CK1 to the gate line GLi through the output node O as the i-th gate signal Gi.

The carry unit 340 may include a fifteenth transistor T15. The control terminal of the carry unit 340 is connected to the control node Q, the input terminal thereof receives the first clock signal CK1, and the output terminal thereof is connected to the (i+1)-th stage ST(i+1) that is one of the next stages. When the high voltage is applied to the control node Q, the carry unit 340 outputs the high voltage of the first clock signal CK1 to the (i+1)-th stage ST(i+1) as the i-th carry signal CRi.

The first discharge unit 351 may include a ninth transistor T9. The control terminal of the first discharge unit 351 is connected to the (i+1)-th stage ST(i+1), the input terminal thereof is connected to the control node Q, and the output terminal thereof is connected to the first voltage interconnection VSL1. The first discharge unit 351 discharges the voltage applied to the control node Q as the low voltage VSS in response to the high voltage of the (i+1)-th gate signal G(i+1) that is output from the (i+1)-th stage.

The second discharge unit 352 may include a second transistor T2. The control terminal of the second discharge unit 352 is connected to the (i+1)-th stage ST(i+1), the input terminal thereof is connected to the output node Q, and the output terminal thereof is connected to the first voltage interconnection VSL1. The second discharge unit 352 discharges the voltage applied to the output node down to the low voltage VSS in response to the high voltage of the (i+1)-th gate signal G(i+1).

The third discharge unit 353 may include a sixth transistor T6. The control terminal of the third discharge unit 353 receives a reset signal RS, the input terminal thereof is connected to the control node Q, and the output terminal thereof is connected to the first voltage interconnection VSL1. The third discharge unit 353 discharges the voltage applied to the control node Q as the low voltage VSS in response to the high voltage of the reset signal RS.

The switching unit 370 may include a twelfth transistor T12, a seventh transistor T7, a thirteenth transistor T13 and an eighth transistor T8. When the high voltage is applied to the output node O, the eighth and thirteenth transistors T8 and T13 are turned on to discharge the voltage applied to an N node N connected to the second holding unit 382 down to the low voltage VSS. When the low voltage is applied to the output node O, the eighth and the thirteenth transistors T8 and T13 are turned off to apply a signal that is synchronized with the first clock signal CK1 to the N node N.

The first holding unit 381 may include a tenth transistor T10. The control terminal of the first holding unit 381 receives the first clock signal, the input terminal thereof is connected to the control node Q, and the output terminal thereof is connected to the output node O. The first holding unit 381 holds the voltage of the control node Q as the voltage of the output node O in response to the high voltage of the first clock signal CK1.

The second holding unit 382 may include a third transistor T3. The control terminal of the second holding unit 382 is connected to the N node N, the input terminal thereof is connected to the output node O, and the output terminal thereof is connected to the first voltage interconnection VSL1.

The second holding unit 382 holds the voltage of the output node O as the low voltage VSS in response to the high voltage that is applied to the N node N.

The third holding unit 383 may include an eleventh transistor T11. The control terminal of the third holding unit 383 is connected to the second clock interconnection CLK2 to receive the second clock signal CK2, the input terminal thereof receives the (i−1)-th carry signal CR(i−1) of the (i−1)-th stage, and the output terminal thereof is connected to the control node Q. The third holding unit 383 holds the voltage of the control node Q as the voltage level of the (i−1)-th carry signal CR(i−1) in response to the high voltage of the second clock signal CK2.

The fourth holding unit 384 may include a fifth transistor T5. The control terminal of the fourth holding unit 284 receives the second clock signal CK2, the input terminal thereof is connected to the output node O, and the output terminal thereof is connected to the first voltage interconnection VLS1. The fourth holding unit 284 holds the voltage of the output node O as the low voltage VSS in response to the high voltage of the second clock signal CK2.

The second sub-stage STi-2 of the i-th stage STi, which is positioned in the display area DA, may include at least one of the pull-up unit 330 and the second discharge unit 352. In an exemplary embodiment, as shown in FIG. 4, the second sub-stage STi-2 may include both the pull-up unit 330 and the second discharge unit 352, and the first sub-stage STi-1 may include the remaining configuration except for the configuration included in the second sub-stage STi-2. In an alternative exemplary embodiment, at least parts of the buffer unit 310, the charge unit 320, the carry unit 340, the first discharge unit 351, the third discharge unit 353, the switching unit 370, the first holding unit 381, the second holding unit 382, the third holding unit 383 and the fourth holding unit 384 may be further included in the second sub-stage STi-2. Hereinafter, for convenience of description, an exemplary embodiment, where the second sub-stage STi-2 includes both the pull-up unit 330 and the second discharge unit 352 as illustrated in FIG. 4, will be described in detail, but the invention is not limited thereto.

The driving signal interconnection unit 900 may be further positioned in the driving area GDA (in FIG. 2) in which the second sub-stage STi-2 is positioned in the display area DA. The driving signal interconnection unit 900 is an interconnection that transfers signals to the second sub-stage STi-2, and may be arranged to extend substantially in the row direction substantially parallel to the gate line GLi.

The driving signal interconnection unit 900 may include first to fourth signal interconnections 910, 930, 950 and 970.

The first signal interconnection 910 may be electrically connected to the first clock interconnection CLK2 to receive the first clock signal CK1.

The second signal interconnection 930 may be electrically connected to the control node Q to receive the voltage that is applied to the control node Q.

The third signal interconnection 950 may be electrically connected to the first voltage interconnection VSL1 to receive the low voltage VSS.

The fourth signal interconnection 970 may receive the (i+1)-th gate signal G(i+1) that is output from the (i+1)-th stage.

In an exemplary embodiment, the first transistor T1 of the pull-up unit 330 is connected to the driving signal interconnection unit 900. In such an embodiment, as shown in FIG. 4, the control terminal of the first transistor T1 may be connected to the second signal interconnection 930 of the driving signal interconnection unit 900 to receive the voltage that is applied to the control node Q. In such an embodiment, the input terminal of the first transistor T1 may be connected to the first signal interconnection 910 to receive the first clock signal CK1, and the output terminal of the first transistor T1 may be connected to the gate line GLi.

In an exemplary embodiment, the second transistor T2 of the second discharge unit 352 is connected to the driving signal interconnection unit 900. In such an embodiment, as shown in FIG. 4, the control terminal of the second transistor t2 may be connected to the fourth signal interconnection 970 connected to the (i+1)-th stage ST(i+1) to receive the (i+1)-th gate signal G(i+1). In such an embodiment, the input terminal of the second transistor T2 may be connected to the output terminal of the first transistor or the gate line GLi, and the output terminal of the second transistor T2 may be connected to the third signal interconnection 950 to receive the low voltage VSS. Referring to FIGS. 1 to 5, in an exemplary embodiment, a compensation capacitor Ccs may be positioned in the electrode area CEA in which the second sub-stage STi-2 is not positioned in the display area DA. The compensation capacitor Ccs is a capacitor for compensating for the coupling capacitance that may occur as the second sub-stage STi-2 is positioned in the display area DA. The first terminal of the compensation capacitor Ccs is connected to the data line DL2, and the second terminal thereof is connected to the compensation electrode CE (in FIG. 2). As described above, the holding voltage Vcst may be applied to the compensation electrode CE (in FIG. 2), and the holding voltage Vcst may be provided to the second terminal of the compensation capacitor Ccs, but is not limited thereto. In an alternative exemplary embodiment, the second terminal of the compensation capacitor Ccs may be in a floating state.

Figure 6:
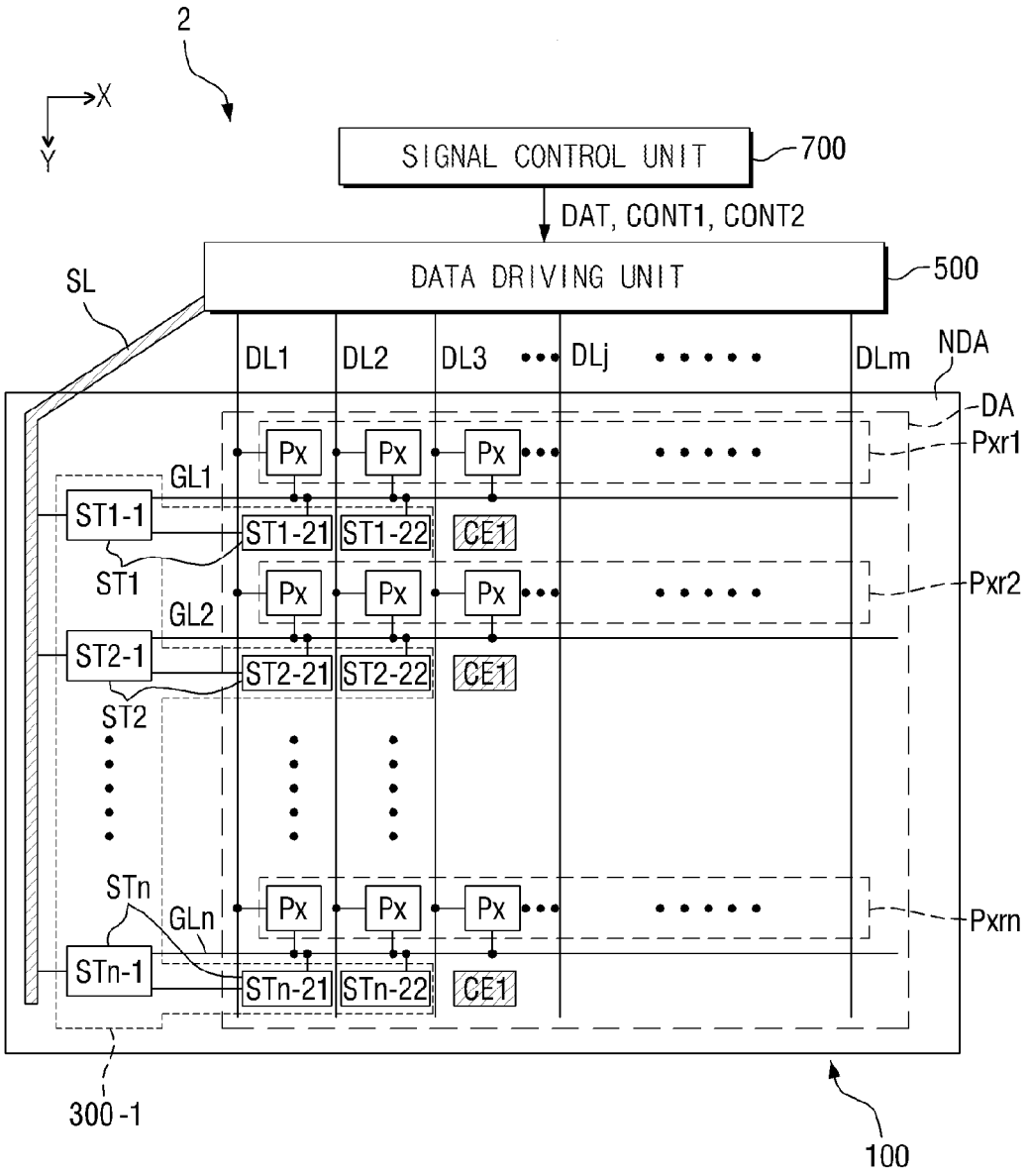
FIG. 6 is a schematic plan view of an alternative exemplary embodiment of a display device according to the invention.

FIG. 6 is a schematic plan view of an alternative exemplary embodiment of a display device according to the invention.

Referring to FIG. 6, an exemplary embodiment of a display device 2 includes a gate driving unit 300-1 that has a different arrangement from the arrangement of the gate driving unit 300 of the exemplary embodiment of the display device 1 illustrated in FIG. 1. The same or like elements shown in FIG. 6 have been labeled with the same reference characters as used above to describe the exemplary embodiments of the display device shown in FIG. 1, and any repetitive detailed description thereof will hereinafter be omitted or simplified.

In an exemplary embodiment, the gate driving unit 300-1 of the display device 2 may include a plurality of stages ST1 to STn. The plurality of stages ST1 to STn may include first sub-stages ST1-1 to STn-1 and second sub-stages ST1-21, ST1-22 to STn-21, and STn-22. In one exemplary embodiment, for example, each stage may include one first sub-stage and two second sub-stages that may be electrically connected to each other.

The first sub-stages ST1-1 to STn-1 may be positioned in the non-display area NDA. The second sub-stages ST1-21, ST1-22 to STn-21, and STn-22 may be positioned in the display area DA, and may be positioned between the two adjacent pixel rows in the column direction (or Y direction) among the plurality of pixel rows Pxr1 to Pxrn as described above with reference to FIG. 1.

In such an embodiment, as shown in FIG. 6, each stage includes two second sub-stages ST1-21, ST1-22 to STn-21, and STn-22. In an exemplary embodiment, the second sub-stages ST1-21, ST1-22 to STn-21, and STn-22 may be divided into first portions ST1-21 to STn-21 and second portions ST1-22 to STn-22 that are arranged in parallel according to the row direction (or X direction) as illustrated in FIG. 6. In an exemplary embodiment, the second sub-stages ST1-21, ST1-22 to STn-21, and STn-22 to STn-2 may be divided into two portions along the row direction, but not being limited thereto. In an alternative exemplary embodiment, the second sub-stages may be divided into three or more portions. The exemplary embodiment of the display device 2 shown in FIG. 6 may be substantially the same as the exemplary embodiment of the display device 1 shown in FIG. 1 expect that the second sub-stages are divided into two or more parts.

Figure 7:
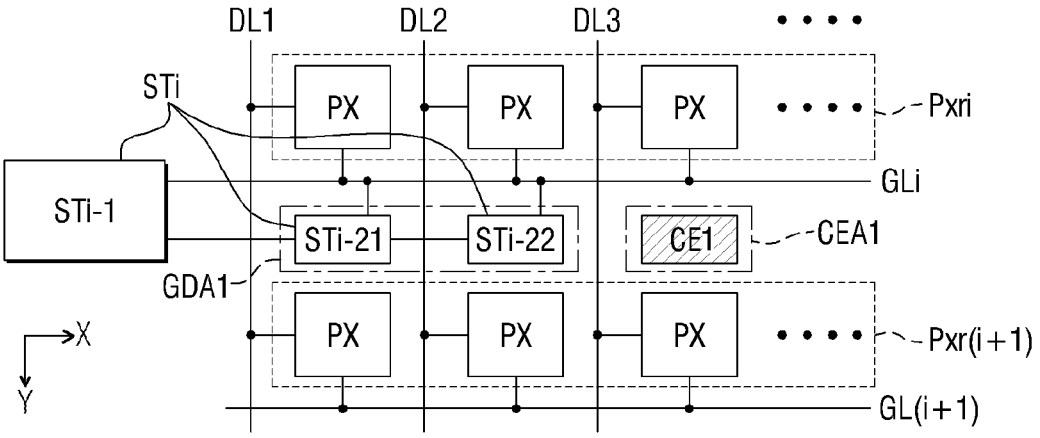
FIG. 7 is a schematic enlarged plan view of a part of an exemplary embodiment of a display device according to the invention.

FIG. 7 is a schematic enlarged plan view of a part of an exemplary embodiment of a display device according to the invention. FIG. 7 is a block diagram showing the arrangement relationship between pixel rows, one stage, and a compensation electrode in the display device illustrated in FIG. 6.

Referring to FIGS. 6 and 7, two adjacent pixel rows Pxr1 and Pxr(i+1) along the column direction (or Y direction) may be connected to the gate lines GLi and GL(i+1), respectively, and a driving area GDA-1 and an electrode area CEA-1 may be defined between the two pixel rows Pxr1 and Pxr(i+1) (here, i is a natural number that is equal to or less than n-1).

The driving area GDA-1 shown in FIG. 7 is substantially the same as the driving area GDA illustrated in FIG. 2 except that the driving area GDA-1 is positioned between two or more pairs of adjacent pixels Px along the column direction.

As described above with reference to FIG. 6, a stage, e.g., an i-th stage STi, may include a first sub-stage STi-1 and second sub-stages STi-21 and STi-22. The first sub-stage STi-1 may be positioned in the non-display area NDA, and the second sub-stages STi-21 and STi-22 may be positioned in the driving area GDA-1 in the display area DA.

In an exemplary embodiment, the electrode area CEA-1 may be defined in a portion in a space between two pixel rows Pxri and Pxr(i+1) except for the driving area GDA-1, and the compensation electrode CE1 may be positioned in the electrode area CEA-1.

In an exemplary embodiment, the compensation electrode CE1 may be a floating electrode. In such an embodiment, a holding voltage Vcst may be applied to the compensation electrode CE1, and the holding voltage Vcst may be applied to the compensation electrode CE1 through a separate interconnection (not illustrated in the drawing).

In such an embodiment, the compensation electrode CE1 is substantially the same as or is similar to the compensation electrode CE as described above with reference to FIG. 2, and any repetitive detailed description thereof will be omitted.

Figure 8:
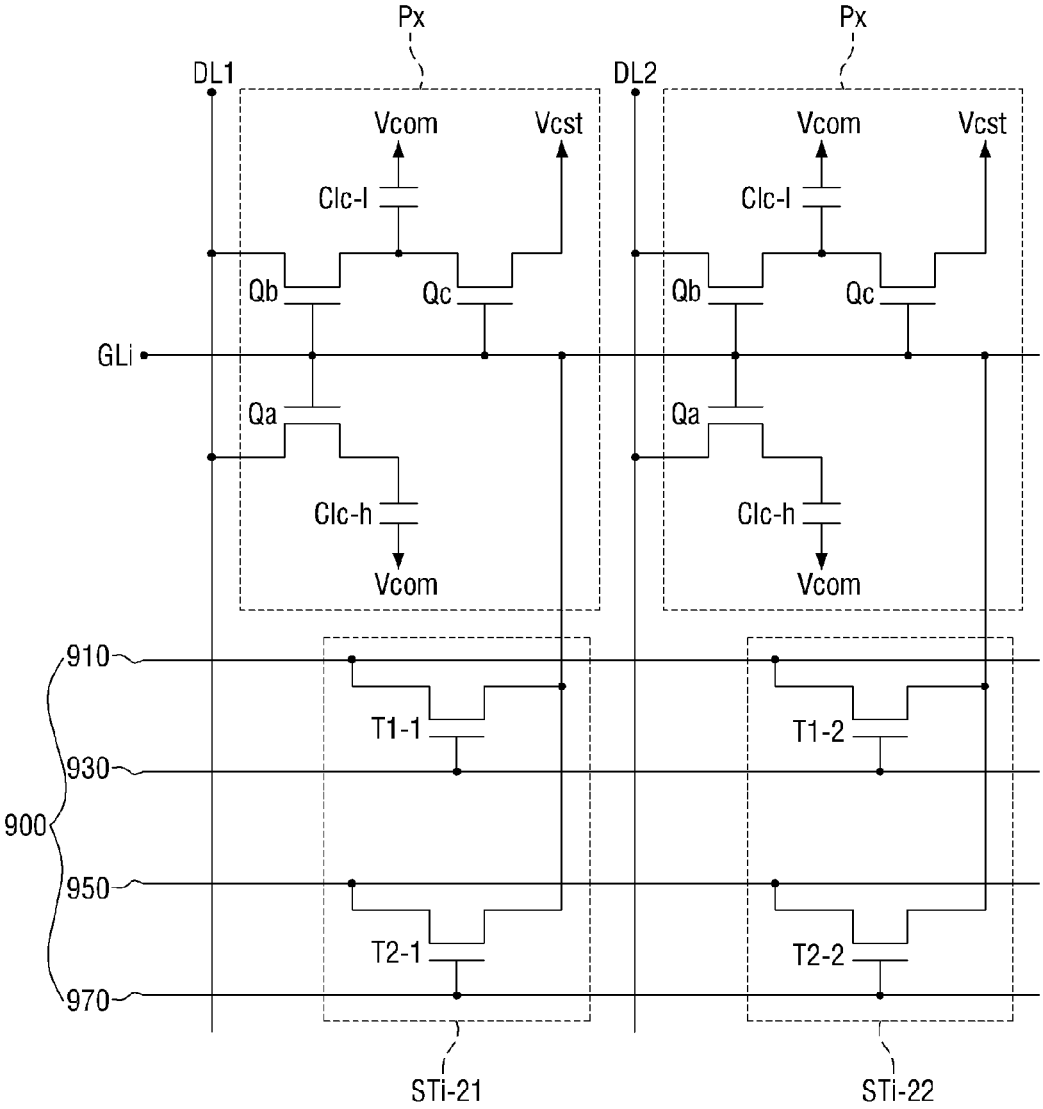
FIGS. 8 and 9 are equivalent circuit diagrams showing parts of an exemplary embodiment of a display device according to the invention.
Figure 9:
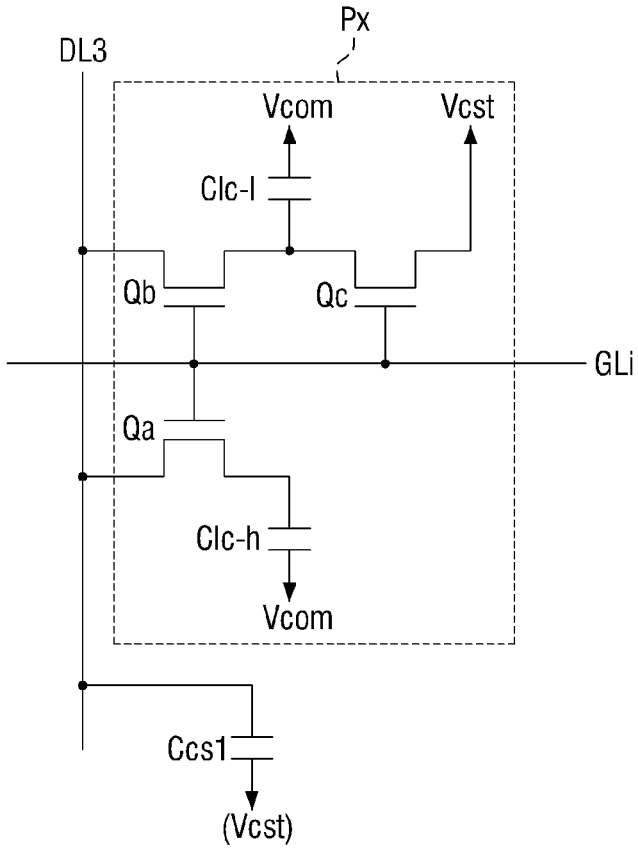

FIGS. 8 and 9 are equivalent circuit diagrams of a part of an alternative exemplary embodiment of a display device according to the invention. More specifically, FIG. 8 is an equivalent circuit diagram of the second sub-stage positioned in the display area DA and the pixel, and FIG. 9 is an equivalent circuit diagram of the compensation electrode and the pixel.

In such an embodiment, the equivalent circuit diagram of the first sub-stage Sti-1 (in FIG. 6), the control signal line SL (in FIG. 6) and the driving signal interconnection unit 900 is substantially the same as or is similar to the equivalent circuit diagram of those described above with reference to FIG. 4, and any repetitive detailed description thereof will be omitted.

Referring to FIGS. 4 and 8, in an exemplary embodiment, a first portion STi-21 of the second sub-stages STi-21 and STi-22 may include a first partial transistor T1-1 and a second partial transistor T2-1, and a second portion STi-22 may include a third partial transistor T1-2 and a fourth partial transistor T2-2. The control terminals of the first partial transistor T1-1 and the third partial transistor T1-2 may be connected to a second signal interconnection 930 to receive a voltage that is applied to the control node Q (in FIG. 4). In such an embodiment, the input terminals of the first partial transistor T1-1 and the third partial transistor T1-2 may be connected to a first signal interconnection 910 to receive the first clock signal CK1 (in FIG. 4), and the output terminals of the first partial transistor T1-1 and the third partial transistor T1-2 may be connected to the gate line GLi.

In such an embodiment, the first partial transistor T1-1 and the second partial transistor T2-1 may have the same function as the first transistor T1 (in FIG. 4) of the pull-up unit 330 (in FIG. 4) illustrated in FIG. 4.

The control terminals of the second partial transistor T2-1 and the fourth partial transistor T2-2 may be connected to a fourth signal interconnection 970 that is connected to the (i+1)-th stage ST(i+1) to receive the (i+1)-th gate signal G(i+1). The input terminal of the second partial transistor T2-1 may be connected to the output terminal of the first partial transistor T1-1 or the gate line GLi, and the input terminal of the fourth partial transistor T2-2 may be connected to the output terminal of the third partial transistor T1-2 or the gate terminal GLi. The output terminals of the second partial transistor T2-1 and the fourth partial transistor T2-2 may be connected to a third signal interconnection 950 to receive the low voltage VSS.

In such an embodiment, the second partial transistor T2-1 and the fourth partial transistor T2-2 may have the same function as the second transistor T2 (in FIG. 4) of the second discharge unit 352 (in FIG. 4) illustrated in FIG. 4.

Referring to FIG. 9, a compensation capacitor Ccs1 may be positioned in the electrode area CEA1 in which the second sub-stages STi-21 and STi-22 are not positioned in the display area DA. The compensation capacitor Ccs1 is a capacitor for compensating for the coupling capacitance that may occur due to the second sub-stages STi-21 and STi-22. The first terminal of the compensation capacitor Ccs1 is connected to the data line DL3, and the second terminal thereof is connected to the compensation electrode CE1 (in FIG. 5). As described above, the holding voltage Vcst may be applied to the compensation electrode CE1 (in FIG. 5), and the holding voltage Vcst may be provided to the second terminal of the compensation capacitor Ccs1, but is not limited thereto. In an alternative exemplary embodiment, the second terminal of the compensation capacitor Ccs1 may be in a floating state.

According to exemplary embodiments of the invention as described above with reference to FIGS. 1 to 9, a part of the gate driving unit is arranged in the display area, such that the non-display area may be reduced, and thus the bezel of the display device may also be reduced. In such embodiments, the compensation electrode is disposed in the display area, such that the display quality deterioration, which may occur as the part of the gate driving unit is arranged in the display area, may be effectively prevented.

Although some exemplary embodiments of the invention have been described for illustrative purposes, those skilled in the art will appreciate that various modifications, additions and substitutions are possible, without departing from the scope and spirit of the invention as disclosed in the accompanying claims.

What is claimed is:

1. A display device comprising:

a display substrate, on which a display area and a non-display area are defined;

a plurality of gate lines arranged in the display area to extend substantially in a first direction;

a gate driving unit comprising a plurality of stages and successively connected to output gate signals to the plurality of gate lines; and a plurality of pixel rows disposed in the display area and connected to the plurality of gate lines, wherein a driving area and an electrode area are defined in the display area between two adjacent pixel rows in a second direction among the plurality of pixel rows, at least a part of the plurality of stages is disposed in the driving area, and a compensation electrode is disposed in the electrode area.

2. The display device of claim 1, wherein an n-th stage among the plurality of stages comprises:

a first transistor which outputs a first clock signal as an n-th gate signal; and a second transistor which discharges a voltage of an output node connected to the first transistor down to a low voltage, wherein n is a natural number, and the first transistor and the second transistor are disposed in the driving area.

3. The display device of claim 2, wherein at least one of the first transistor and the second transistor comprises a plurality of transistors disconnected from each other.

4. The display device of claim 2, wherein the first transistor includes a control terminal connected to a control node of the n-th stage, an input terminal to which the first clock signal is applied, and an output terminal connected to an n-th gate line among the plurality of gate lines, and the second transistor includes a control terminal to which a gate signal from a next stage of the n-th stage is applied, an input terminal which receives the low voltage, and an output terminal connected to the output terminal of the first transistor.

5. The display device of claim 2, wherein the n-th stage further comprises a third transistor which discharges the voltage of the output node down to the low voltage in response to a signal synchronized with the first clock signal.

6. The display device of claim 2, wherein the n-th stage further comprises a carry unit which outputs the first clock signal as an n-th carry signal in response to a signal applied to a control terminal of the first transistor.

7. The display device of claim 2, wherein the n-th stage further comprises:

a first holding unit comprising a transistor including a control terminal which receives the first clock signal, an input terminal connected to a control terminal of the first transistor, and an output terminal connected to an output terminal of the first transistor;

a second holding unit which holds a voltage applied to the control terminal of the first transistor as a low voltage of a carry signal from a previous stage in response to a second clock signal;

a third holding unit which holds a voltage applied to the output terminal of the first transistor as the low voltage in response to the second clock signal;

a second discharge unit which discharges a voltage applied to the control terminal of the first transistor down to the low voltage in response to a reset signal; and a first discharge unit which discharges the voltage applied to the control terminal of the first transistor down to the low voltage in response to a gate signal received from a next stage.

8. The display device of claim 1, wherein the driving area is defined at an edge of the display area.

9. The display device of claim 1, wherein the compensation electrode is disposed in a same layer as the plurality of gate lines.

10. The display device of claim 1, wherein the compensation electrode receives a holding voltage.

11. The display device of claim 1, further comprising:

a plurality of data lines extending substantially in the second direction on the display area, wherein a pixel in the plurality of pixel rows comprises:

a first sub-pixel comprising a first sub-pixel electrode and a first pixel transistor; and a second sub-pixel comprising a second sub-pixel electrode, a second pixel transistor, and a third pixel transistor, and wherein the first pixel transistor includes a control terminal connected to a corresponding gate line of the plurality of gate lines, an input terminal connected to a corresponding data line of the plurality of data lines, and an output terminal connected to the first sub-pixel electrode, the second pixel transistor includes a control terminal connected to the corresponding gate line, an input terminal connected to the corresponding data line, and an output terminal connected to the second sub-pixel electrode, and the third pixel transistor includes a control terminal connected to the corresponding gate line, an input terminal connected to the output terminal of the second pixel electrode, and an output terminal to which a holding voltage is applied.

12. A display device comprising:

a display substrate, on which a display area and a non-display area are defined;

a plurality of gate lines arranged in the display area to extend substantially in a first direction;

a gate driving unit comprising a plurality of stages which outputs gate signals to the plurality of gate lines; and a plurality of pixel rows disposed in the display area and connected to the plurality of gate lines, wherein a driving area and an electrode area are defined in the display area between two adjacent pixel rows in a second direction among the plurality of pixel rows, and a driving signal interconnection unit, which is electrically connected to the gate driving unit and is arranged to extend substantially in the first direction, is disposed in the driving area, wherein an n-th stage among the plurality of stages comprises:

a first sub-stage disposed in the non-display area; and a second sub-stage disposed in the driving area and connected to the first sub-stage and a corresponding gate line, wherein n is a natural number.

13. The display device of claim 12, wherein the driving signal interconnection unit comprises:

a first signal interconnection to which a first clock signal is applied; and a second signal interconnection electrically connected to a control node of the first sub-stage, and the second sub-stage comprises a transistor including a control terminal connected to the second signal interconnection, an input terminal connected to the first signal interconnection, and an output terminal connected to an n-th gate line among the plurality of gate lines.

14. The display device of claim 13, wherein the driving signal interconnection unit further comprises:

a third signal interconnection to which a low voltage is applied; and a fourth signal interconnection to which a gate signal from a next stage of the n-th stage is applied, and the second sub-stage further comprises a transistor including a control terminal connected to the fourth signal interconnection, an input terminal connected to the third signal interconnection, and an output terminal connected to the output terminal of the first transistor.

15. A display device comprising:

a display substrate, on which a display area and a non-display area are defined;

a plurality of gate lines arranged in the display area to extend substantially in a first direction;

a gate driving unit comprising a plurality of stages which outputs gate signals to the plurality of gate lines; and a plurality of pixel rows disposed in the display area and connected to the plurality of gate lines, wherein a driving area and an electrode area are defined in the display area between two adjacent pixel rows in a second direction among the plurality of pixel rows, and a driving signal interconnection unit, which is electrically connected to the gate driving unit and is arranged to extend substantially in the first direction, is disposed in the driving area, and wherein the display device further comprising:

a compensation electrode disposed in the electrode area.

16. The display device of claim 15, wherein the compensation electrode is disposed in a same layer as the plurality of gate lines.

17. The display device of claim 15, wherein the compensation electrode receives a holding voltage.

18. A display device comprising:

a display substrate, on which a display area and a non-display area are defined;

a plurality of gate lines arranged in the display area to extend substantially in a first direction;

a gate driving unit comprising a plurality of stages which outputs gate signals to the plurality of gate lines; and a plurality of pixel rows disposed in the display area and connected to the plurality of gate lines, wherein a driving area and an electrode area are defined in the display area between two adjacent pixel rows in a second direction among the plurality of pixel rows, and a driving signal interconnection unit, which is electrically connected to the gate driving unit and is arranged to extend substantially in the first direction, is disposed in the driving area, and wherein the driving area is defined at an edge of the display area.

19. A display device comprising:

a display substrate, on which a display area and a non-display area are defined;

a plurality of gate lines arranged in the display area to extend substantially in a first direction;

a gate driving unit comprising a plurality of stages which outputs gate signals to the plurality of gate lines; and a plurality of pixel rows disposed in the display area and connected to the plurality of gate lines, wherein a driving area and an electrode area are defined in the display area between two adjacent pixel rows in a second direction among the plurality of pixel rows, and a driving signal interconnection unit, which is electrically connected to the gate driving unit and is arranged to extend substantially in the first direction, is disposed in the driving area, and wherein the display device further comprising:

a plurality of data lines extending substantially in the second direction on the display area, wherein a pixel in the plurality of pixel rows comprises:

a first sub-pixel comprising a first sub-pixel electrode and a first pixel transistor; and a second sub-pixel comprising a second sub-pixel electrode, a second pixel transistor, and a third pixel transistor, the first pixel transistor has a control terminal connected to a corresponding gate line of the plurality of gate lines, an input terminal connected to a corresponding data line of the plurality of data lines, and an output terminal connected to the first sub-pixel electrode, the second pixel transistor has a control terminal connected to the corresponding gate line, an input terminal connected to the corresponding data line, and an output terminal connected to the second sub-pixel electrode, and the third pixel transistor has a control terminal connected to the corresponding gate line, an input terminal connected to the output terminal of the second pixel electrode, and an output terminal to which a holding voltage is applied.

* * * * *